US006309256B1

(12) United States Patent
Hosono et al.

(10) Patent No.: US 6,309,256 B1
(45) Date of Patent: Oct. 30, 2001

(54) ELECTRIC PLUG

(75) Inventors: Takeshi Hosono; Minoru Yokota, both of Kawasaki (JP)

(73) Assignee: Kawasaki Electric Wire Co., Ltd. (JP)

( * ) Notice: Subject to any disclaimer, the term of this patent is extended or adjusted under 35 U.S.C. 154(b) by 0 days.

(21) Appl. No.: 09/575,365

(22) Filed: May 22, 2000

(30) Foreign Application Priority Data

May 20, 1999 (JP) ..... 11-140313
Apr. 7, 2000 (JP) ..... 12-105882

(51) Int. Cl.[7] ..... H01R 13/04
(52) U.S. Cl. ..... 439/692
(58) Field of Search ..... 439/692, 693, 439/694, 695, 696, 697, 647, 651, 655, 597

(56) References Cited

U.S. PATENT DOCUMENTS 2,193,294 * 3/1940 Osenberg ..... 439/692
2,457,789 * 12/1948 Von Scheven ..... 439/692
3,781,913 * 12/1973 Liburdi ..... 339/37
3,848,957 * 11/1974 Brush ..... 339/176
4,080,036 * 3/1978 Hagel ..... 339/103
4,346,419 * 8/1982 Janniello ..... 361/2

FOREIGN PATENT DOCUMENTS 3021727 12/1995 (JP) .
8-236189 9/1996 (JP) .

* cited by examiner

*Primary Examiner*—Gary Paumen
*Assistant Examiner*—Alexander Gilman
(74) *Attorney, Agent, or Firm*—Parkhurst & Wendel, L.L.P.

(57) ABSTRACT

An electric plug made of a synthetic resin material and capable of preventing tracking comprises a plug main body made of a synthetic resin material such as PVC, a pair of blades connected to electrical wires exposed at one end of a cable, and a groove formed in the front face portion of the plug main body at a position between the blades, so that the blades are prevented from becoming short-circuited due to the presence of dust or water-drops between the plug blades.

7 Claims, 7 Drawing Sheets

PRIOR ART

ELECTRIC PLUG

BACKGROUND OF THE INVENTION

The present invention relates to an electric plug capable of preventing a tracking of a main body of the plug made of a synthetic resin material.

As shown in FIG. 7, an electric plug or electric power supply plug 1 comprises a pair of electrically conductive blades 3, 3 respectively electrically connected to the tip ends of electrical wires of a cord or cable 2, a plug body 4 formed by extrusion-molding process of a synthetic resin material so as to allow the front portions of the parallel-blades 3, 3 to become exposed, and a bellows 5, and generally the plug body 4 and the bellows 5 are integrally formed by a thermoplastic polyvinyl chloride resin material (PVC).

However, since the electric plug made of PVC is considered to lack the resistance against tracking (the formation of a carbonized electrically conductive path due to a short-circuiting through dust or water-drops and an electric breakdown resulting therefrom), it is said to be unsuitable for use with strict specifications (for example, the 250V and 20A condition).

One of proposals for eliminating such problem is disclosed in the specification of the Japanese Utility Model No. 3021727. The attachment plug disclosed in this specification is of the type having a structure such that it has a plurality of terminals (corresponding to the parallel-electrically conductive blades) extending from the front face portion of the plug main body and that a thermosetting resin portion having a suitable thickness, which is hardly carbonized, is formed on the entire front face of the plug main body and a concave portion for increasing the creeping distance along an outer surface of the front face portion between the opposing surfaces of the terminals is formed.

Apart from the attachment plug disclosed in the above-described specification, there is another proposal disclosed in the Japanese Patent Laid-Open Publication No. H8-236189 such that a space filling means is provided at the root portions of a pair of electrically connecting terminals (electrically conductive blades) that extend from the plug main body so as to increase the above-described creeping distance between the terminals. According to this structure, about a half of each of the electrically connecting terminals (blades) is practically covered with a resin material.

However, the above-described prior art electric power supply plugs have the disadvantage that since the main body of each of the electric plugs is made up of the thermosetting resin portion and the soft synthetic resin portion, the manufacturing process becomes complicated and both of the resin portions lack the integrality thereof. Further, the structure in which about one half of each of the plug bodies is covered with a synthetic resin material has a serious problem in productivity with respect to its yield because the plug blades are required to be processed within the range prescribed by the industrial standard.

SUMMARY OF THE INVENTION

Accordingly, the present invention has been made to eliminate the above-described disadvantages of the prior art.

In order to solve the above-described disadvantages, the present invention basically makes use of a technical conception such that a plug main body which supports parallel-electrically conductive blades (terminals) is formed with a synthetic resin material with the formation of a groove between the blades on the side of the front face portion thereof.

The employment of such technical conception makes it possible to increase the creeping distance of the outer surface of the front face portion of the plug body between the blades and to remove dust and water-drops outside so that the anti-tracking characteristic of the plug body is improved thereby making it possible to improve an electric power supply plug made of a vinyl chloride resin material only.

More concretely, an object of the present invention is to provide an electric plug comprising a plug body provided with a pair of electrically conductive blades respectively electrically connected to bare electrical wires of an electrical cable at the tip end of the cable and covered with a synthetic resin material in such a manner that the front portions of the pair of blades are kept projecting from the front face portion of the plug body and characterized in that a groove is formed on the front face portion of the plug body so as make it open to the front face portion and both planar portions of the plug body and the plug body is made of a single material.

Further, another object of the present invention is to provide an electric plug comprising a plug body provided with a pair of electrically conductive blades respectively electrically connected to bare electrical wires of an electrical cable at the tip end of the cable and covered with a synthetic resin material in such a manner that the front portions of the pair of plug blades are kept projecting from the front face portion of the body and characterized in that a groove and a hole are formed in the front face portion of the plug body at a position between the pair of plug blades with the groove being kept open outside through the hole and both planar portions of the plug body and the plug body is made of a single material.

MODES FOR CARRYING OUT THE INVENTION

Embodiment 1

Figure 1:
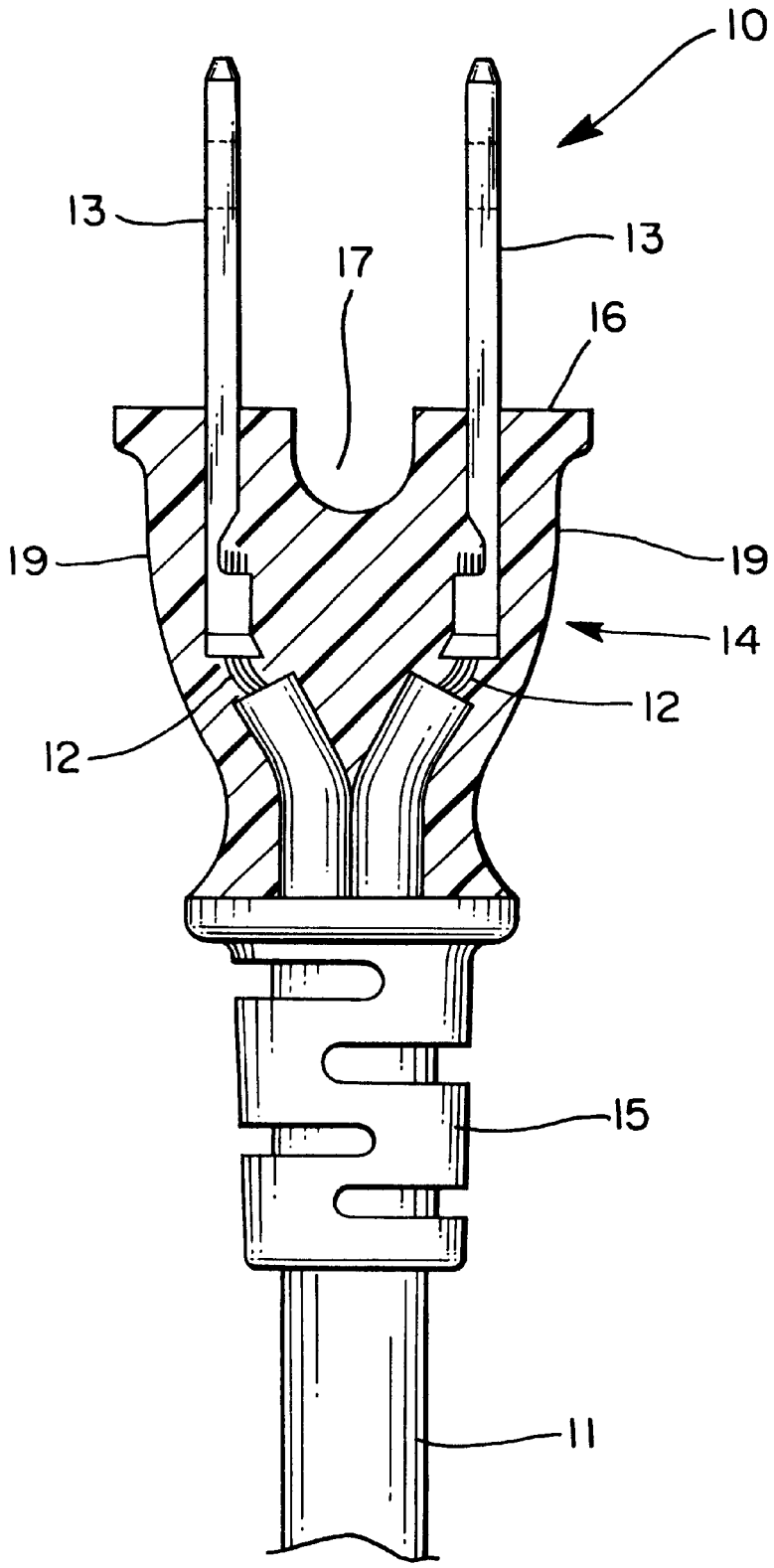
FIG. 1 is a front view (partially cut away)) of an electric plug according to one embodiment of the present invention.
Figure 2:
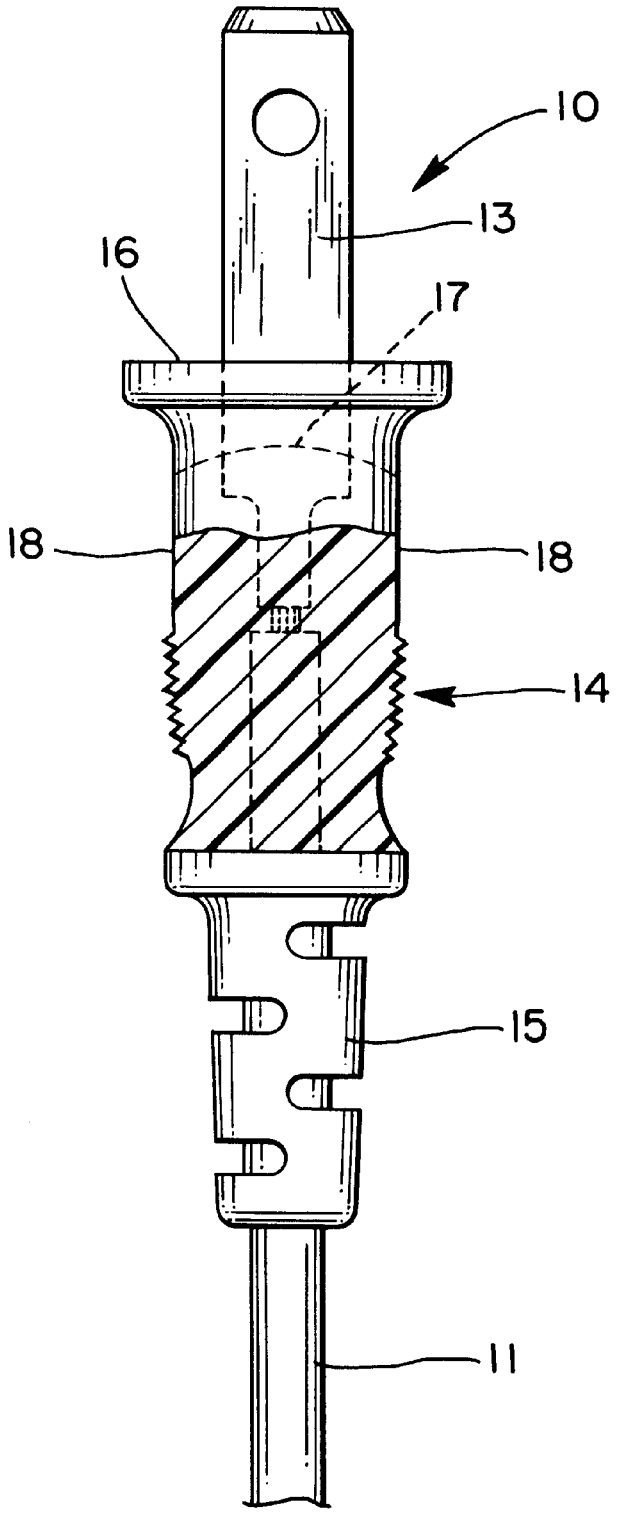
FIG. 2 is a side view (partially cut away) of the plug shown in FIG. 1.

As shown in FIGS. 1 and 2, an electric plug or electric power supply plug 10 comprises a pair of electrically conductive blades 13, 13 made of an electrically conductive metal and connected to bare electrical wires 12, 12 exposed at one tip end of a cord or cable 11 and a plug body 14 formed by injection-molding a vinyl chloride resin (PVC) material so as to partially cover the blades 13, 13 and the cable 11. The plug body 14 comprises two planar portions 18, 18 forming the thickness of the plug body 14, a main body portion defined by two side portions 19, 19 forming the width o f the plug body 14, a bellows 15 formed integral with the main body portion and a front face portion 16 formed integral with the main body portion with its peripheral portion extending outwardly of the main body portion.

Further, a groove 17 extending through the front face portion 16 and the main body portion is formed at a position between the blades 13, 13. The groove 17 has a bottom substantially semi-circular in section so as to open toward both planar surface portions 18, 18 and the front face portion 16 of the plug body 14. Further, the depth of the groove 17 is larger toward both of the planar surface portions 18, 18 and the bottom surface thereof inclines upward at the center.

The width of the cavity or groove 17 is desirably half the distance between the blades 13, 13 and the width somewhat greater than the depth of the groove 17, when the distance between the blades 13, 13 is 12.7 mm. The dimensions of the groove 17 optimally balance the mechanical strength of the plug body against the insulating distance between the internal metals.

The provision of such groove 17 makes the creeping distance between the blades 13, 13 along the front face portion 16 larger than when the front face portion 16 is made planar without the formation of the groove 17 so that the danger of causing a short-circuiting between the blades 13, 13 due to the presence of dust or water-drops adhered to the front face portion 16 is remarkably reduced.

In the shown embodiment, an aqueous solution was dropped between the blades 13, 13 under the anti-tracking test conditions stipulated by the Japan Wiring Instrument Association (i.e., an aqueous solution of 0.2% ammonium chloride was dropped between the blades 13, 13 every 5 minute interval with one drop being in the order of 20 $mm^3$ while a rated voltage and a rated current are applied therebetween) but no tracking phenomenon was found even after the application of 2000 drops.

The vinyl chloride resin material has been considered unsuitable for an electric plug or electric power supply plug of which strict anti-tracking specifications are required since it is easily carbonized and the development of any other materials has been made while neglecting the favorable workability of the vinyl chloride resin material. However, by the proposal of the basic technical concept of the present invention, it has become possible to secure the anti-tracking characteristic of the electric plug made of the vinyl chloride resin material under strict test conditions.

Embodiment 2

Figure 3:
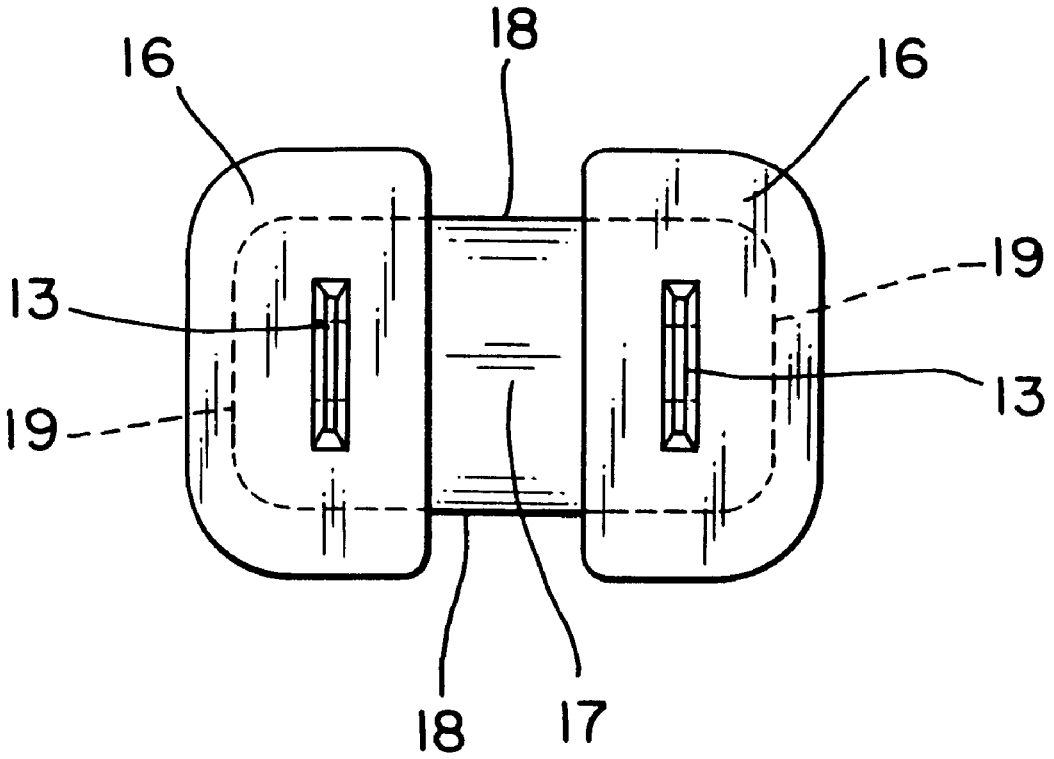
FIG. 3 is a plan view of the plug shown in FIG. 1.
Figure 4:
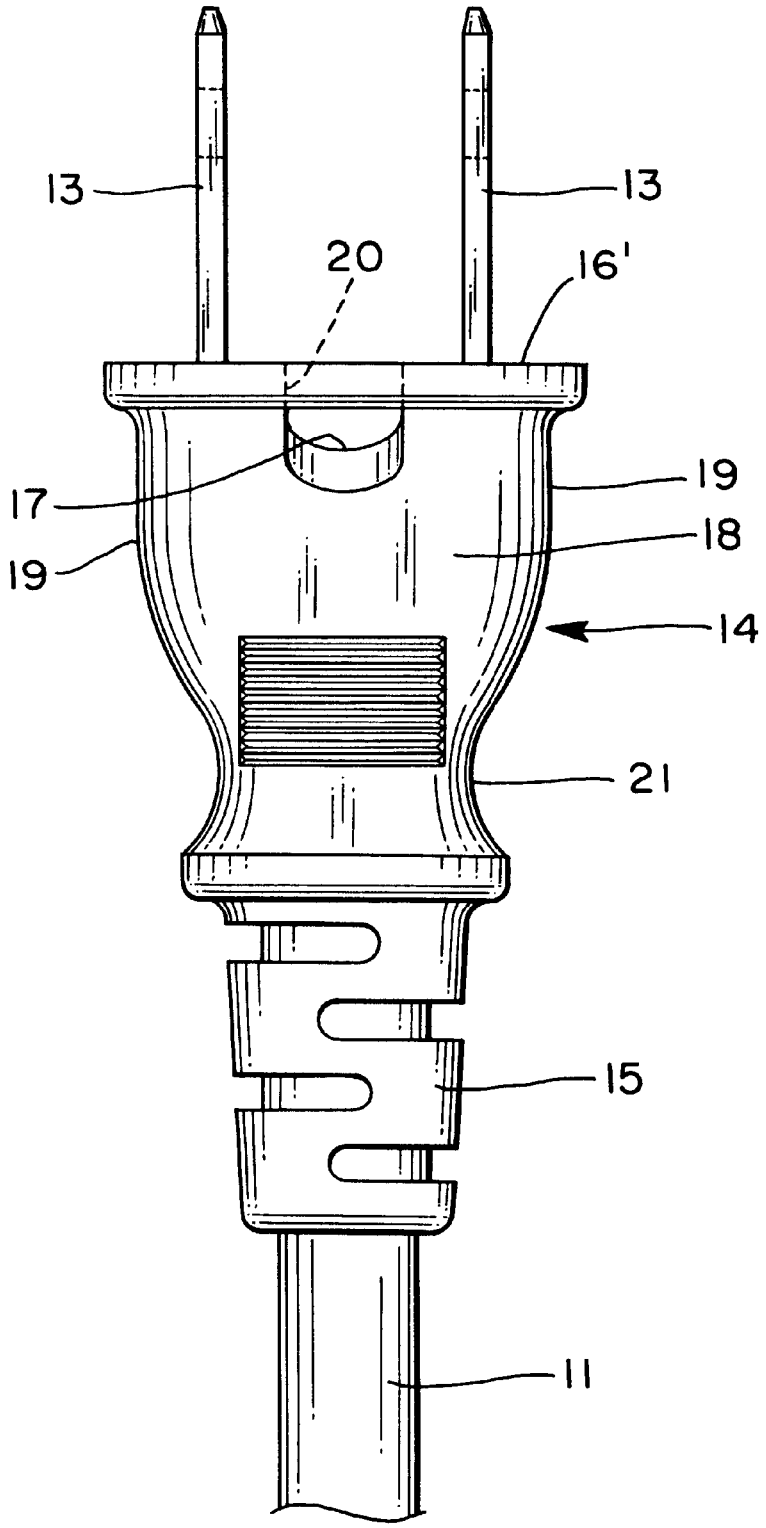
FIG. 4 is a front view of an electric plug according to a second embodiment of the present invention.
Figure 5:
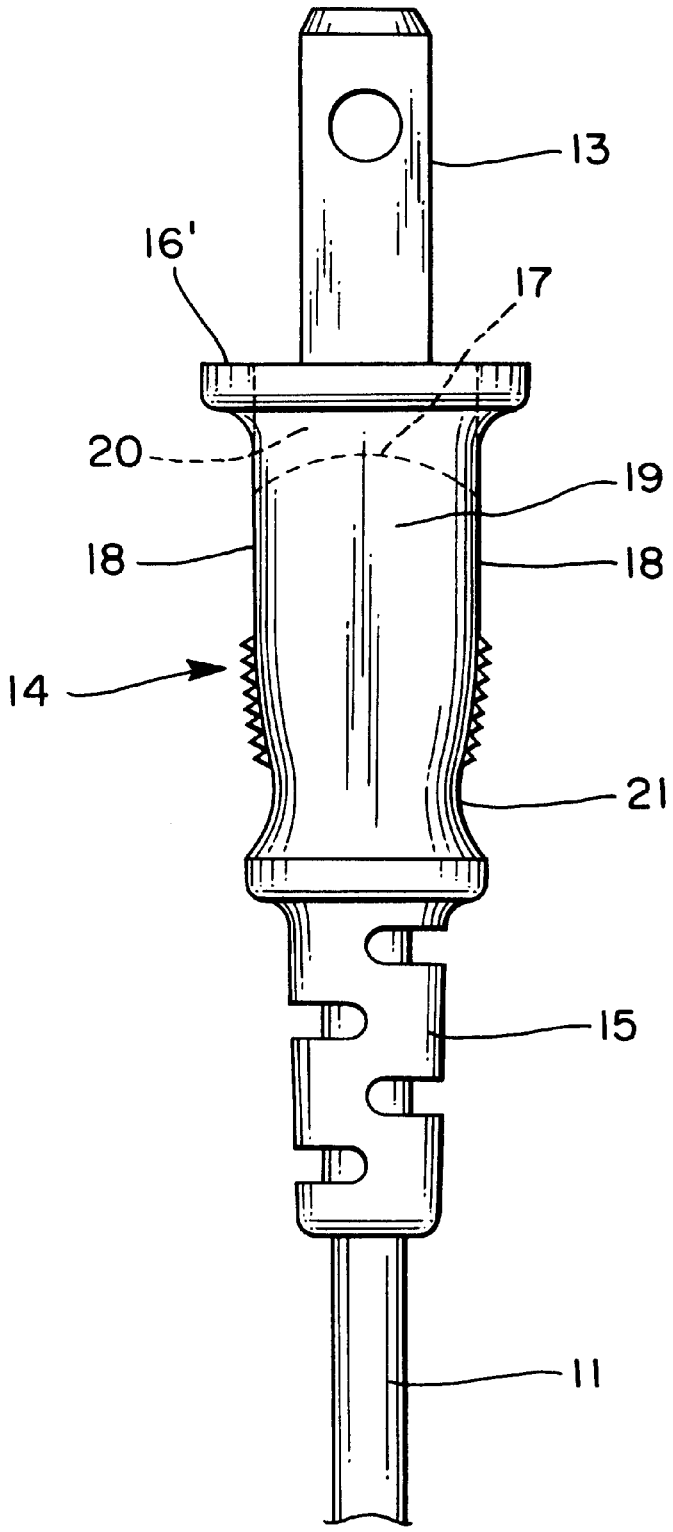
FIG. 5 is a side view of the plug shown in FIG. 4.
Figure 6:
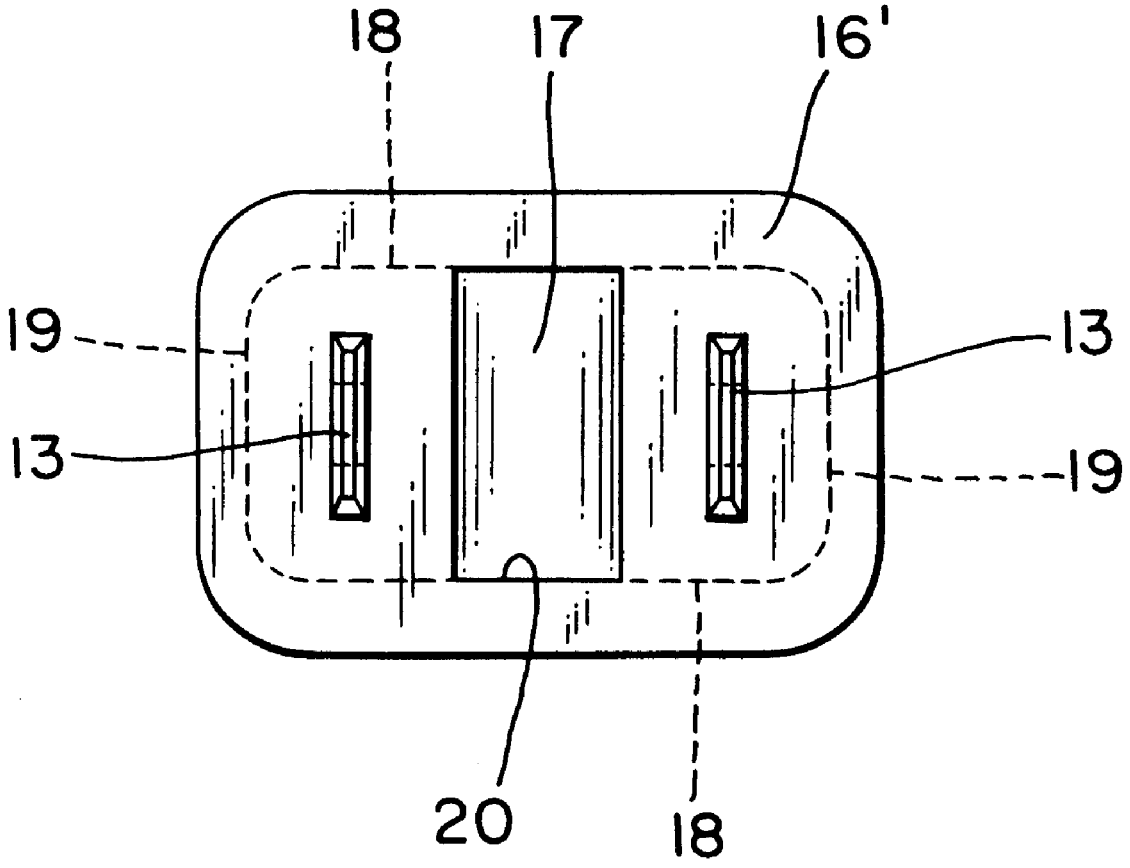
FIG. 6 is a plan view of the plug shown in FIG. 4.
Figure 7:
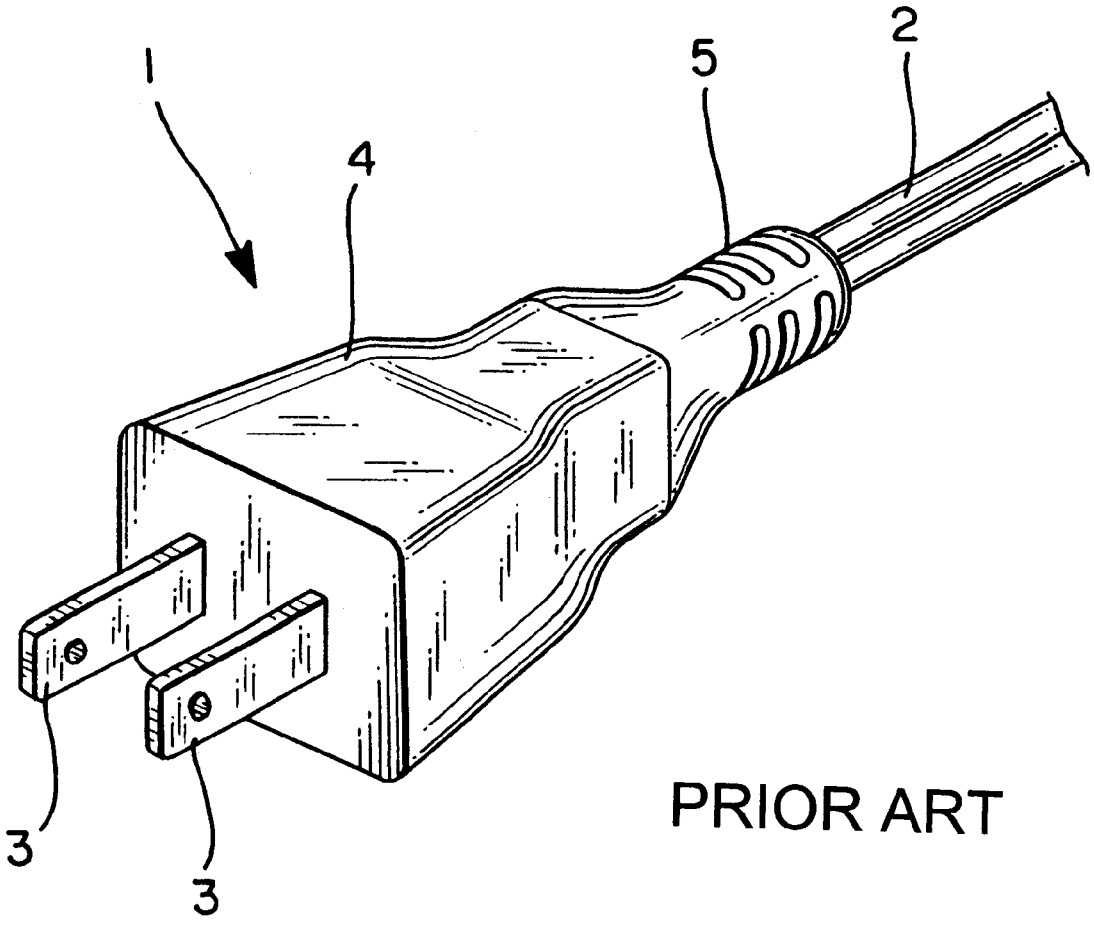
FIG. 7 is a perspective view of a conventional electric plug.

In FIGS. 4 through 6, there is shown a second embodiment of the present invention. This embodiment differs from the first embodiment shown in FIGS. 1 through 3 with respect to the front face portion 16' of the plug body 14 thereof as will be described later while the other portions of the former are the same as those of the latter so that the description of the other portions may be omitted.

The front face portion 16' has a peripheral edge extended sidewardly of the main body portion of the plug body 14 made of a vinyl chloride resin material and is provided with a hole 20 allowing the groove 17 to open forward.

The first embodiment shown in FIGS. 1 through 3 differs in structure from the second embodiment shown in FIGS. 4 through 6. The front face portion 16 of the first embodiment is entirely divided right and left by the cavity or groove 17. In contrast, the front face portion 16' of the second embodiment defines a hole 20 which opens on both planar portions 18 of the main body portion of the electric plug.

The hole 20 of the front face portion 16' should preferably be the same as the groove 17 in length and width and this front face portion 16' is effective for preventing the opening of the main body portion about the groove 17 and the falling and inclination of the blades 13, 13. Particularly, it is effective for preventing the opening of the main body portion of the plug about the groove 17 and the falling or inclination of the blades 13, 13 resulting from the softening of the PVC body due to a temperature rise.

Further, in addition to the above-described anti-tracking characteristic, the second embodiment of the present invention has such advantage that the peripheral edge of the front face portion 16' extends outwardly of the main body portion, the user can hold on to the peripheral edge of the front face portion 16' with his fingers thereby facilitating the handling of the power supply plug 10.

Still further, there may be provided a dent or concave portion 21 at the lower portion of the main body of the plug body 14 and in the vicinity of the bellows 15 thereby facilitating the pulling out and insertion of the plug from and into a consent to which is to be connected. Further, the portion above the concave portion 21 may be knurled to prevent the slipping of the user's fingers.

As many apparently widely different embodiments of the present invention can be made without departing from the spirit and scope thereof, it is to be understood that the invention is not limited to the specific embodiments thereof except as defined in the appended claims.

What is claimed is:

1. An electric plug comprising:

a plug body comprising vinyl chloride resin, comprising a front face portion and two side surfaces abutting opposite sides of the front face portion;

a pair of electrically conductive blades comprising front exterior and back interior portions, the front portions of the blades projecting from the front face portion of the plug body;

an electrical wire and blade connection portion at which the back interior portion of each blade connects to a separate electrical wire at an end of an electrical cable; and a cavity between the pair of blades opening into the front face portion and into both side surfaces of the plug body, the cavity having a bottom surface inclined and extending more deeply toward both side surfaces than in the center between the side surfaces, relative to the front face portion.

2. The electric plug as claimed in claim 1, wherein the bottom surface of said cavity comprises a semi-circular cross-section and the bottom surface lies between the electrical wire and blade connection portions.

3. The electric plug as claimed in claim 2, wherein the width of the cavity, measured along an axis formed between the blades, is half the distance separating the blades.

4. An electric plug comprising:

a plug body comprising a single synthetic resin comprising a front face portion and two side surf aces abutting opposite sides of the front face portion;

a pair of blades comprising front exterior and back interior portions, the front portions of the pair of blades projecting from the front face portion of the plug body;

an electrical wire and blade connection portion at which the back interior portion of each blade connects to a separate electrical wire at an end of an electrical cable; and a hole between the blades, the hole defined in the front face and in both side surfaces of the plug body, the hole comprising an interior cavity and three openings, one opening on the front face, and one of each side surface, the three openings of the hole entering into the interior cavity.

5. The electric plug as claimed in claim 4, wherein the widths of all three hole openings, measured along an axis formed between the blades, is half the distance separating the blades.

6. The electric plug as claimed in claim 4, wherein said plug body comprises vinyl chloride resin, and the hole further comprises a bottom surface opposite the opening of the front face portion, the surface is inclined and extending more deeply toward both side surfaces than in the center between the side surfaces relative to the front face portion.

7. The electric plug as claimed in claim 4, wherein the bottom surface of said hole comprises a semi-circular cross-section and the bottom surface lies between the electrical wire and blade connection portions.

* * * * *